US007739848B2

(12) United States Patent
Trout

(10) Patent No.: US 7,739,848 B2
(45) Date of Patent: Jun. 22, 2010

(54) ROOFING PANEL INTERLOCK SYSTEM

(76) Inventor: Kathy Trout, 510 N. Sheridan Unit B, Corona, CA (US) 91880

( * ) Notice: Subject to any disclaimer, the term of this patent is extended or adjusted under 35 U.S.C. 154(b) by 108 days.

(21) Appl. No.: 11/330,709

(22) Filed: Jan. 12, 2006

(65) Prior Publication Data

US 2008/0047215 A1 Feb. 28, 2008

Related U.S. Application Data

(60) Provisional application No. 60/643,795, filed on Jan. 12, 2005.

(51) Int. Cl.
*E04C 2/00* (2006.01)
*E04C 3/00* (2006.01)

(52) U.S. Cl. ..... 52/581; 52/588.1; 52/580; 52/589.1; 52/533; 52/590.1; 52/592.1; 52/591.2; 52/309.4; 52/309.8; 52/309.15; 52/309.9

(58) Field of Classification Search ..... 52/263, 52/578, 580, 581, 588.1, 589.1, 590.1, 309.7, 52/309.9, 309.11, 309.4, 309.8, 586.1, 592.1, 52/586.2, 584.1, 470–471, 533, 539, 474, 52/506.01, 506.1, 782.1, 783.1, 783.11, 787.1, 52/792.1, 792.11, 794.1, 796.1, 506.08, 309.14, 52/309.15, 591.3
See application file for complete search history.

(56) References Cited

U.S. PATENT DOCUMENTS 3,742,672 A * 7/1973 Schaeufele ..... 52/592.1
4,186,539 A * 2/1980 Harmon et al. ..... 52/580
4,769,963 A * 9/1988 Meyerson ..... 52/309.9
4,918,895 A * 4/1990 Landheer ..... 52/580
5,086,599 A * 2/1992 Meyerson ..... 52/309.9
5,293,728 A * 3/1994 Christopher et al. ..... 52/588.1
5,381,638 A * 1/1995 Andersson ..... 52/592.1
5,448,865 A * 9/1995 Palmersten ..... 52/309.9
5,502,939 A * 4/1996 Zadok et al. ..... 52/309.9
5,613,338 A 3/1997 Esposito
6,122,879 A * 9/2000 Montes ..... 52/592.1
6,314,701 B1 * 11/2001 Meyerson ..... 52/588.1
6,718,721 B2 * 4/2004 Albany et al. ..... 52/588.1

* cited by examiner

*Primary Examiner*—Jeanette Chapman
(74) *Attorney, Agent, or Firm*—Michael J. Feigin, Esq.; http://PatentLawNY.com

(57) ABSTRACT

An insulated building panel includes a male connector configuration as well as a female connector configuration that are both formed of generally bent surfaces. The male connector as well as the female connector extends outwardly from the side faces of an insulating foam core so that the foam is protected from damage. The male connector is formed by bending the metal edge into a generally U shaped configuration with the outer edge of the U bent downwardly towards the interior of the panel. The female connector is bent back almost towards itself and terminates in a curvilinear gutter portion. The female portion includes a detent edge that defines a shallow receptacle into which a male detent edge is inserted so as to lock the male and female connectors in a nested position, thereby securing two panels together.

8 Claims, 3 Drawing Sheets

ROOFING PANEL INTERLOCK SYSTEM

CROSS REFERENCE TO RELATED APPLICATIONS

The present application is related to and takes priority from U.S. Provisional Patent Application Ser. No. 60/643,795, filed Jan. 12, 2005, entitled Roofing Panel Interlock System, the entire contents of which are expressly incorporated herein by reference.

FIELD OF THE INVENTION

This invention relates to modular panel structures for constructing side and overhead portions of structures and more particularly to modular panel structures provided with improved interlocking edges.

BACKGROUND OF THE INVENTION

Insulated building panels are well known in the present art and are commonly used for modular construction of walls and ceilings. These types of panels are generally formed of two outer thin layers of aluminum or sheet steel, which cover an interior core layer of an insulating material, such as plastic, foam, or the like.

Many different shapes and sizes of such building panels have been known and used over the years and various means of coupling two panels together have been discussed. Typically, one edge of the panel will be formed into a male-type connection member, while the other edge is formed into a corresponding mating female-type connector.

While effective in allowing coupling of adjacent panels together, the prior-art systems are configured in such a manner that they allow moisture, in the form of rain and condensation, to introduce itself into the interior of the panel, thereby wetting the insulating core and threatening the integrity of the panels. Prior art systems are capable of locking two panels together, but do not have the capability of self-guttering rain and other moisture away from the panel joint.

Accordingly, what is required in the art is a building panel interlock joint that is formed in such a manner as to direct rain or other moisture away from the panel seam, while promoting an interlock fit and maintaining the advantageous features and qualities of interlocking building panels.

SUMMARY OF THE INVENTION

An insulated building panel, according to the present invention, includes a male connector configuration as well as a female connector configuration that are both formed of generally bent surfaces. The male connector as well as the female connector extends outwardly from the side faces of an insulating foam core so that the foam is protected from damage. The male connector, is formed by bending the metal edge into a generally U shaped configuration with the outer edge of the U bent downwardly towards the interior of the panel. The female connector is bent back almost towards itself and terminates in a curvilinear gutter portion. The female portion includes a detent edge which defines a shallow receptacle into which a male detent edge is inserted so as to lock the male and female connectors in a nested position, thereby securing two panels together.

DESCRIPTION OF THE DRAWINGS

These and other features, aspects and advantages of the present invention will be more completely understood when considered in connection with the following description, appended claims and accompanying drawings, wherein:

DESCRIPTION OF THE INVENTION

Figure 1:
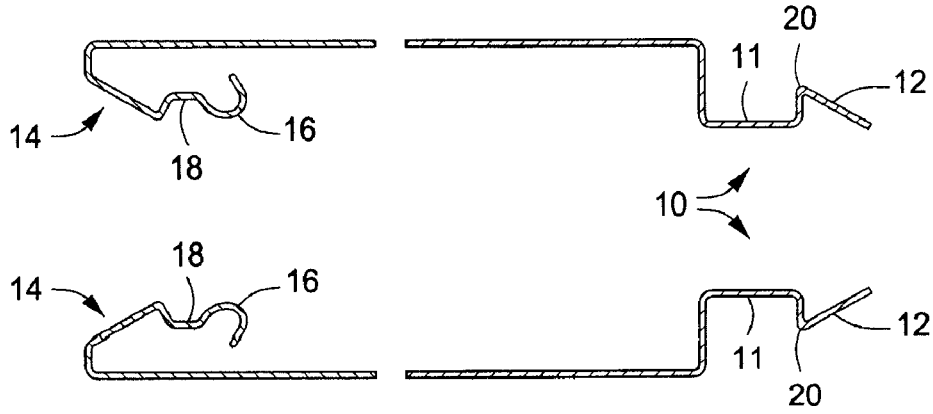
FIG. 1 is a semi-schematic representation of male and female connectors, disposed at opposite ends of a modular panel, in accord with the invention.

A modular building panel includes an interlock mechanism for connecting building panels in series to one another. A panel includes two metal sheets, each overlaying a major surface of the panel, and separated by an insulating foam core, or other similar structural material. The insulating core material is bonded to the inside surfaces of the metal sheets. Each panel includes a first interlocking member on one side and a second interlocking member on the other side, as indicated in FIG. 1, with the interlocking members adapted to be inserted into one another in a male-female manner. The interlocking members secure their respective panels together by a "detent fit".

The male connector configuration as well as the female connector configuration, in the context of the invention, are both formed of generally bent surfaces, with multiple compound bends defining each connector. The male connector as well as the female connector is formed from steel (or aluminum) sheet end portions that extend outwardly from the side faces of the foam so that the foam core is protected from damage.

The male connector, 10 is formed by bending the metal edge into a generally flat bottomed, U shaped configuration 11 with the outer edge 12 of the U (the edge farthest from the foam core) bent downwardly towards the interior of the panel at an acute angle. The apex of the acute angle 20 defines a male "detent" portion devised to mate with a corresponding female detent portion on the other connector. The female connector 14 is bent back almost towards itself and terminates in a curvilinear gutter portion (indicated at 16). The female portion includes a detent edge (indicated at 18) which defines a shallow receptacle into which the male detent edge (indicated at 20) may be inserted so as to lock the male and female connectors in a nested position.

Figure 2:
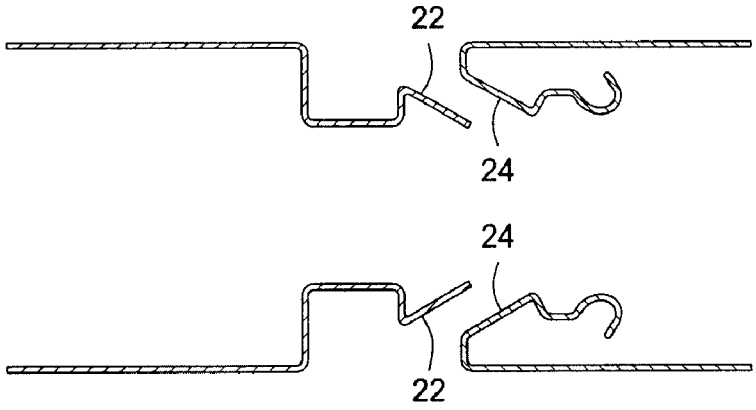
FIG. 2 is a semi-schematic representation of male and female connector portions of two panels being urged into position for interlock.

As shown in FIG. 2, the connector portions are urged together such that angled surfaces of the male 22 and female 24 connectors engage one another, allowing the connectors to slide together and mate with a "spring detent" action.

Figure 3:
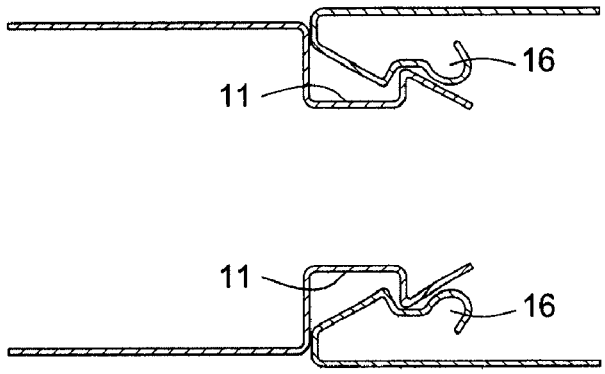
FIG. 3 is a semi-schematic representation of male and female connectors of two adjacent panels after the panels have been "locked" together.

As seen in FIG. 3, when the panels are mated together, the male and female detent edges are juxtaposed so as to lock the respective panels together. The locked together connectors provide a double gutter system to prevent leakage and condensation. The male connector U section 11 defines one of the gutters, while the curvilinear gutter section 16 of the female connector defines another. Characteristically, both connectors have gutter portions provided such that condensation on any one surface, or both surfaces, will be directed away from the core insulation material.

Figure 4A:
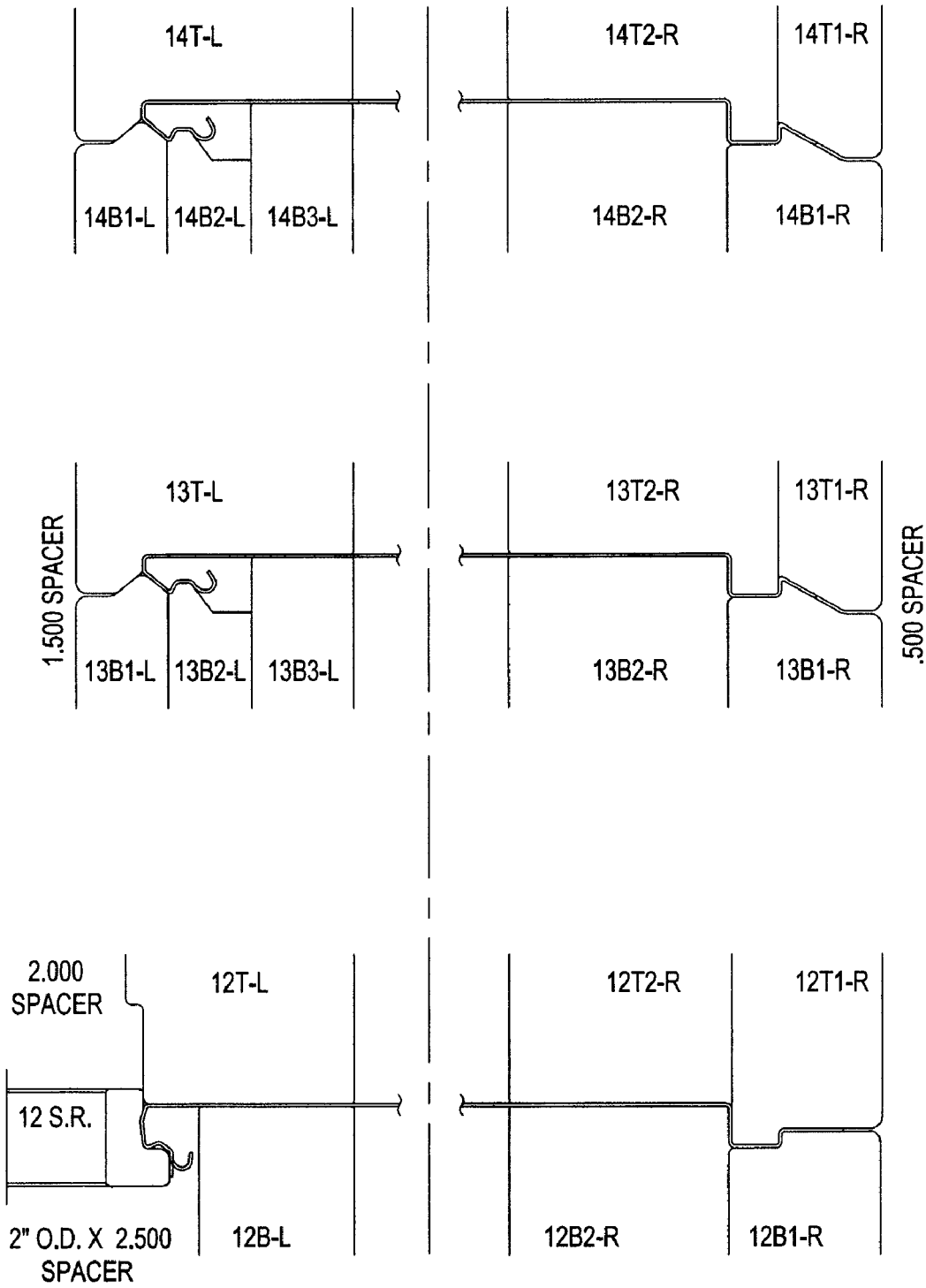
FIG. 4 is a semi-schematic representation of a series of bending operations utilized to form the connectors of the present invention.
Figure 4B:
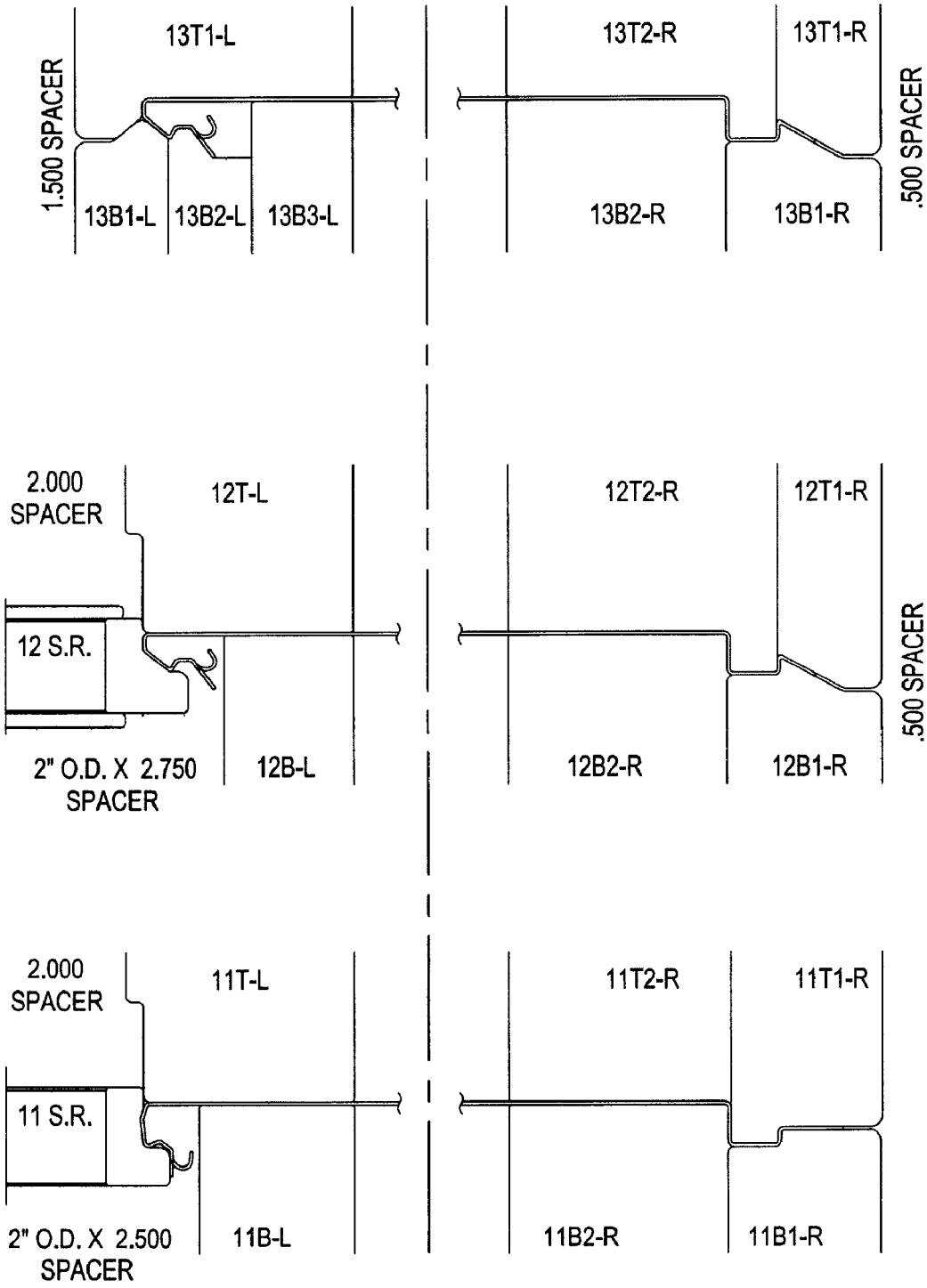

The remaining illustrations of FIG. 4 give an indication of how the connector portions are formed in a metal bending machine. Since the bends are made with several hard radii, the bending operation is carried out in a series of sequential bending operations, each providing a portion of the final "bend" until the completed connector is formed.

It will be obvious to those skilled in the art that many modifications and variations may be made to the structures set forth above without departing from the spirit of the present invention. Accordingly it will be understood that the scope of the present invention is defined solely in terms of the appended claims and their functional equivalents.

The invention claimed is:

1. A modular building panel comprising:

a foam core, a male locking connector and a female locking connector;

said male locking connector comprising a generally U-shaped connecting region with a flat bottom, and one edge of said U-shaped connecting region comprises a bend towards an interior of said panel at an acute angle wherein said female locking connector terminates in a curvilinear gutter portion extending towards an exterior of said building.

2. The modular building panel of claim 1, wherein said female locking connector terminates in a curvilinear gutter portion.

3. The modular building panel of claim 1, wherein said female locking connector further comprises a detent shallow receptacle.

4. The modular building panel of claim 1, wherein said male detent edge is designed to lock into a female detent edge.

5. The modular building panel of claim 1, wherein said one edge is an edge farthest from said foam core.

6. The modular building panel of claim 1, wherein said bend at said acute angle forms a detent.

7. A modular building panel comprising:

a male locking connector comprising a flat-bottomed, generally U-shaped connecting region, and an exterior edge of said U-shaped connecting region comprising a bend towards an interior of said panel at an acute angle;

a female locking connector terminating in a curvilinear gutter and comprising a shallow flat-bottom detent receptacle adapted for engagement with a tip formed by said bend at said acute angle.

8. A modular building panel consisting of:

a foam core, a male locking connector and a female locking connector;

said male locking connector consisting of a generally U-shaped connecting region with a flat bottom, an edge of said U-shaped connecting region farthest from said foam core bent towards an interior of said panel at an acute angle, said acute angle forming a detent;

said female locking connector terminating in a curvilinear gutter portion and further consisting of a flat-bottom detent shallow receptacle;

wherein said male detent edge is designed to lock into a female detent edge.

* * * * *